US008297253B2

(12) United States Patent
Kurowski

(10) Patent No.: US 8,297,253 B2
(45) Date of Patent: Oct. 30, 2012

(54) ROTARY PISTON ENGINE

(76) Inventor: Waldemar Kurowski, Reutlingen (DE)

( * ) Notice: Subject to any disclaimer, the term of this patent is extended or adjusted under 35 U.S.C. 154(b) by 503 days.

(21) Appl. No.: 12/450,497

(22) PCT Filed: Mar. 28, 2008

(86) PCT No.: PCT/EP2008/002447

§ 371 (c)(1),
(2), (4) Date: Sep. 25, 2009

(87) PCT Pub. No.: WO2008/116660

PCT Pub. Date: Oct. 2, 2008

(65) Prior Publication Data

US 2010/0108021 A1 May 6, 2010

(30) Foreign Application Priority Data

Mar. 28, 2007 (DE) ..... 10 2007 015 009

(51) Int. Cl.

| | |
|---|---|
| ***F02B 53/00*** | (2006.01) |
| ***F01C 1/00*** | (2006.01) |
| ***F01C 1/07*** | (2006.01) |
| ***F01C 1/077*** | (2006.01) |
| ***F04C 18/00*** | (2006.01) |
| ***F04C 2/00*** | (2006.01) |

(52) U.S. Cl. ..... 123/245; 123/241; 123/238; 418/36; 418/34

(58) Field of Classification Search ..... 123/245, 123/241; 418/33–38; 74/50, 68
See application file for complete search history.

(56) References Cited

U.S. PATENT DOCUMENTS

| | | | | |
|---|---|---|---|---|
| 1,236,009 | A * | 8/1917 | Hearson | 418/34 |
| 1,243,163 | A * | 10/1917 | Saunders | 418/34 |
| 1,482,627 | A | 2/1924 | Bullington | |
| 1,556,843 | A | 10/1925 | Kinder | |
| 1,568,051 | A * | 1/1926 | Bullington | 123/245 |
| 2,071,528 | A * | 2/1937 | Hover | 123/245 |

(Continued)

FOREIGN PATENT DOCUMENTS

| | | |
|---|---|---|
| DE | 27432 | 0/1884 |

(Continued)

OTHER PUBLICATIONS

International Search Report dated Jul. 30, 2008 (5 pages) Form PCT/ISA/210; Form PCT/ISA/220; and Form PCT/ISA 237.

*Primary Examiner* — Thai Ba Trieu
(74) *Attorney, Agent, or Firm* — Flynn, Thiel, Boutell & Tanis, P.C.

(57) ABSTRACT

A rotary piston engine with a frame, a cylinder liner mounted rotatably therein, a rotor mounted coaxially in the cylinder liner and a gear mechanism connecting the frame, the liner and the rotor, where the gear mechanism is outside a working space arranged between liner and rotor and where the gear mechanism couples the cylinder liner and the rotor for a relative movement periodically oscillating between positive and negative rotational speed. The gear mechanism and the liner form with the rotor a transmission with five rotational joints with a degree of freedom of one and one rotational/prismatic joint, where the gear mechanism has a rotational element mounted rotatably by a first rotational joint on the frame and a connecting rod connected rotatably by a second rotational joint to the rotational element and rotatably by a third rotational joint to the cylinder liner and by the rotational/prismatic joint to the rotor.

6 Claims, 12 Drawing Sheets

U.S. PATENT DOCUMENTS

| | | | | | |
|---|---|---|---|---|---|
| RE21,583 | E | * | 10/1940 | Bancroft | 418/33 |
| 2,816,527 | A | * | 12/1957 | Palazzo | 418/36 |
| 3,144,007 | A | * | 8/1964 | Kauertz | 418/36 |
| 3,327,692 | A | * | 6/1967 | Keagle | 123/245 |
| 3,356,079 | A | * | 12/1967 | Rolfsmeyer | 418/36 |
| 3,439,549 | A | * | 4/1969 | Huschang | 123/245 |
| 3,483,578 | A | * | 12/1969 | Harrison | 418/37 |
| 3,592,571 | A | * | 7/1971 | Drury | 418/36 |
| 3,645,239 | A | * | 2/1972 | Cena | 123/245 |
| 3,719,438 | A | * | 3/1973 | Howard | 418/36 |
| 4,169,697 | A | * | 10/1979 | Doundoulakis | 418/34 |
| 5,304,048 | A | * | 4/1994 | Huang | 418/36 |
| 5,366,356 | A | * | 11/1994 | Volftsun | 418/38 |
| 5,373,819 | A | * | 12/1994 | Linder | 123/238 |
| 5,527,165 | A | * | 6/1996 | Schadeck | 418/36 |
| 6,113,370 | A | * | 9/2000 | Volftsun | 123/245 |
| 6,305,345 | B1 | * | 10/2001 | Bakhtine | 123/245 |
| 6,739,307 | B2 | * | 5/2004 | Morgado | 123/245 |
| 7,828,532 | B2 | * | 11/2010 | Volftsun | 123/245 |
| 7,909,590 | B2 | * | 3/2011 | Pomar | 123/241 |
| 2005/0091848 | A1 | | 5/2005 | Nenov et al. | |
| 2010/0251991 | A1 | * | 10/2010 | Drachko | 418/36 |

FOREIGN PATENT DOCUMENTS

| | | | | |
|---|---|---|---|---|
| DE | 1 926 552 | | | 2/1970 |
| DE | 2 107 137 | | | 8/1972 |
| DE | 2 119 983 | | | 11/1972 |
| DE | 24 21 532 | A1 | | 7/1975 |
| DE | 3226396 | A1 | * | 1/1984 |
| DE | 197 40 133 | A1 | | 3/1999 |
| DE | 197 53 134 | A1 | | 6/1999 |
| EP | 0 013 947 | A1 | | 8/1980 |
| FR | 2694336 | A1 | * | 2/1994 |
| GB | 1031626 | | | 6/1966 |
| GB | 1 552 432 | | | 9/1979 |
| WO | WO 00/79102 | A1 | | 12/2000 |
| WO | WO 2005/045198 | A2 | | 5/2005 |
| WO | WO 2007/009731 | A1 | | 1/2007 |

* cited by examiner

ROTARY PISTON ENGINE

FIELD OF THE INVENTION

The invention relates to a rotary piston engine with a frame, a cylinder liner mounted rotatably in the frame, a rotor mounted coaxially in the cylinder liner and a gear mechanism connecting the frame, the cylinder liner and the rotor, where the gear mechanism is arranged outside a working space defined between cylinder liner and rotor and where the gear mechanism couples the cylinder liner and the rotor so that the rotor periodically leads and lags relative to the cylinder liner.

BACKGROUND OF THE INVENTION

Generic rotary piston engines are known for example from German patent specification DE 27432. A gear mechanism having several connecting rods acts here on two shafts running into one another, one of which is connected to the rotor and the other to the cylinder liner. The gear mechanism has a total of seven rotational joints, i.e. the mounting of the central shaft inside the hollow shaft, the mounting of the hollow shaft inside the frame and two connecting rods each with two rotational joints and a further connecting rod with a total of three rotational joints. The arrangement of the frame around the cylinder and the connecting rod restricts considerably the geometric dimensions of the gear mechanism and the angle range of a relative movement between rotor and cylinder liner.

Further generic rotary piston engines are for example known from the US patent specification U.S. Pat. No. 1,556,843, WO 00/79102 A1, DE 1926552 A1 and EP 0013947 A1.

DE 197 40 133 A1, DE 197 53 134 A1 and WO 2005/045198 A1 propose for a generic rotary piston engine oval-shaped gearwheels, which will scarcely lead to a feasible solution.

WO 2007/009731 A1 describes a very complicated and also scarcely feasible gear mechanism.

All these known rotary piston engines have in common the complicated structure of the gear mechanism, which couples the cylinder liner and the rotor to a relative movement periodically oscillating between a positive and negative rotational speed or to a periodically leading and lagging relative movement of the engine and the cylinder liner.

SUMMARY OF THE INVENTION

The invention is intended to provide a rotary piston engine characterized by a compact design and by a comparatively simple gear mechanism.

To do so, it is provided in accordance with the invention in a generic rotary piston engine that the gear mechanism and the cylinder liner form with the rotor a transmission with five rotational joints with a degree of freedom of 1 and one rotational/prismatic joint, where the gear mechanism has a rotational element mounted rotatably on the frame by means of a first rotational joint, and a connecting rod connected rotatably by a second rotational joint to the rotational element and rotatably by a third rotational joint to the cylinder liner and by the rotational/prismatic joint to the rotor.

With a compactly constructed and comparatively simple gear mechanism of this type, not only can the required periodically oscillating relative movement between rotor and cylinder liner be achieved, but also this oscillating relative movement takes on a very even course with soft transitions. This results in low stresses on the individual joints and above all in low peak forces occurring in these joints. The gear mechanism of the invention hence runs evenly and smoothly and can be rated for high speeds and torques. The rotary piston engine in accordance with the invention forms a six-member flat transmission of the degree of freedom 1 with five rotational joints and one rotational/prismatic joint, also called a turning and sliding joint. A flat transmission refers to one in which all articulation points move in parallel surfaces.

The problem underlying the invention is also solved by a generic rotary piston engine in which the gear mechanism and the cylinder liner form with the rotor a transmission with five rotational joints of the degree of freedom 1 and two gearwheel transmissions, where the gear mechanism has a rotary disc mounted rotatably on the frame by a first rotational joint, a connecting rod connected rotatably by a second rotational joint to the rotary disc and rotatably by a third rotational joint to the cylinder liner, a first gearwheel connected rigidly to a rotor shaft, a second gearwheel connected rigidly to the rotary disc and at least one intermediate gearwheel meshing with the first and second gearwheels.

By using only three rotational joints and two gearwheel transmissions in the gear mechanism, a compact and yet inexpensive design can be achieved. This solution in accordance with the invention is particularly suitable for small and low-torque engines.

The problem underlying the invention is also solved in a generic rotary piston engine in that the gear mechanism and the cylinder liner form together with the rotor a gear with seven rotational joints with a degree of freedom of 1, where the gear mechanism has a rotary disc mounted rotatably on the frame by a first rotational joint, a first connecting rod connected rotatably to the rotary disc by a second rotational joint and rotatably to the cylinder liner by a third rotational joint, and a second connecting rod connected rotatably to the rotary disc by a fourth rotational joint and rotatably to the rotor by a fifth rotational joint.

In this way, the relative movement to be achieved between the cylinder liner and rotor can be obtained with a gear mechanism having exclusively rotational joints with a degree of freedom of 1. A gear mechanism of this type can be manufactured with high precision yet low cost, since only rotational joints have to be made. With appropriate design of these rotational joints, it is possible with this solution in accordance with the invention to transmit even very high torques.

In accordance with a substantial aspect of the invention that can also be implemented regardless of the other design of the gear mechanism, the gear mechanism engages the cylinder liner radially outside the working space.

In this way, it is possible to achieve a very compact design of the rotary piston engine, since the gear mechanism directly follows the cylinder liner and specifically no frame strut is arranged between the gear mechanism and the cylinder liner. The extremely cost-intensive use of shafts running into one another can thus be dispensed with.

In accordance with a further substantial aspect of the invention which can be implemented regardless of the other design features of the gear mechanism, the cylinder liner is mounted inside the frame by its outer circumference.

In this way, the cylinder liner can be mounted on two sides and nevertheless the gear mechanism can engage radially outside the working space with the cylinder liner or with its outer circumference.

Further features and advantages of the invention are revealed by the claims and by the following description of preferred embodiments of the invention in conjunction with the drawings. Individual features of the various embodiments shown and described can here be combined with one another as required without going beyond the scope of the invention.

DETAILED DESCRIPTION

Figure 2A:
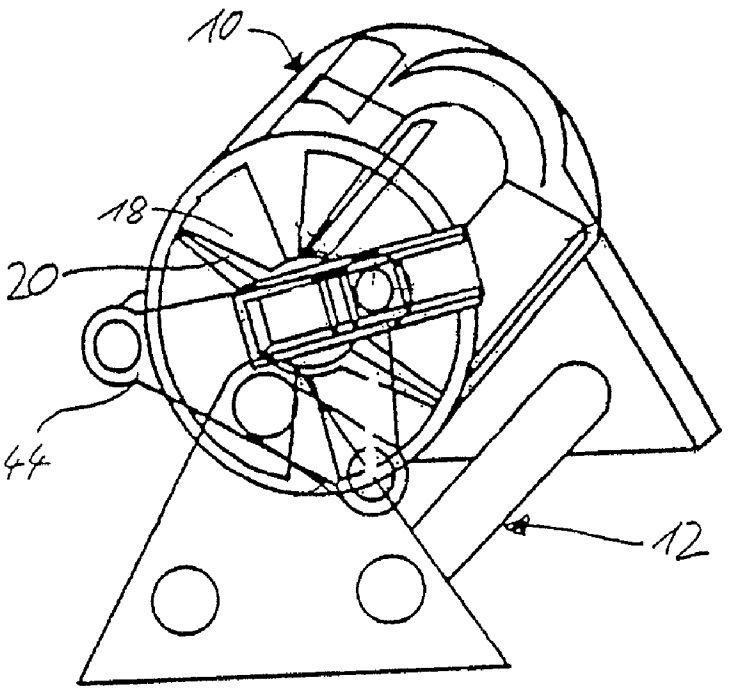
FIG. 2*a* illustrates the rotary piston engine in accordance with the invention and in accordance with the first embodiment as a 3-D wire frame model.
Figure 2B:
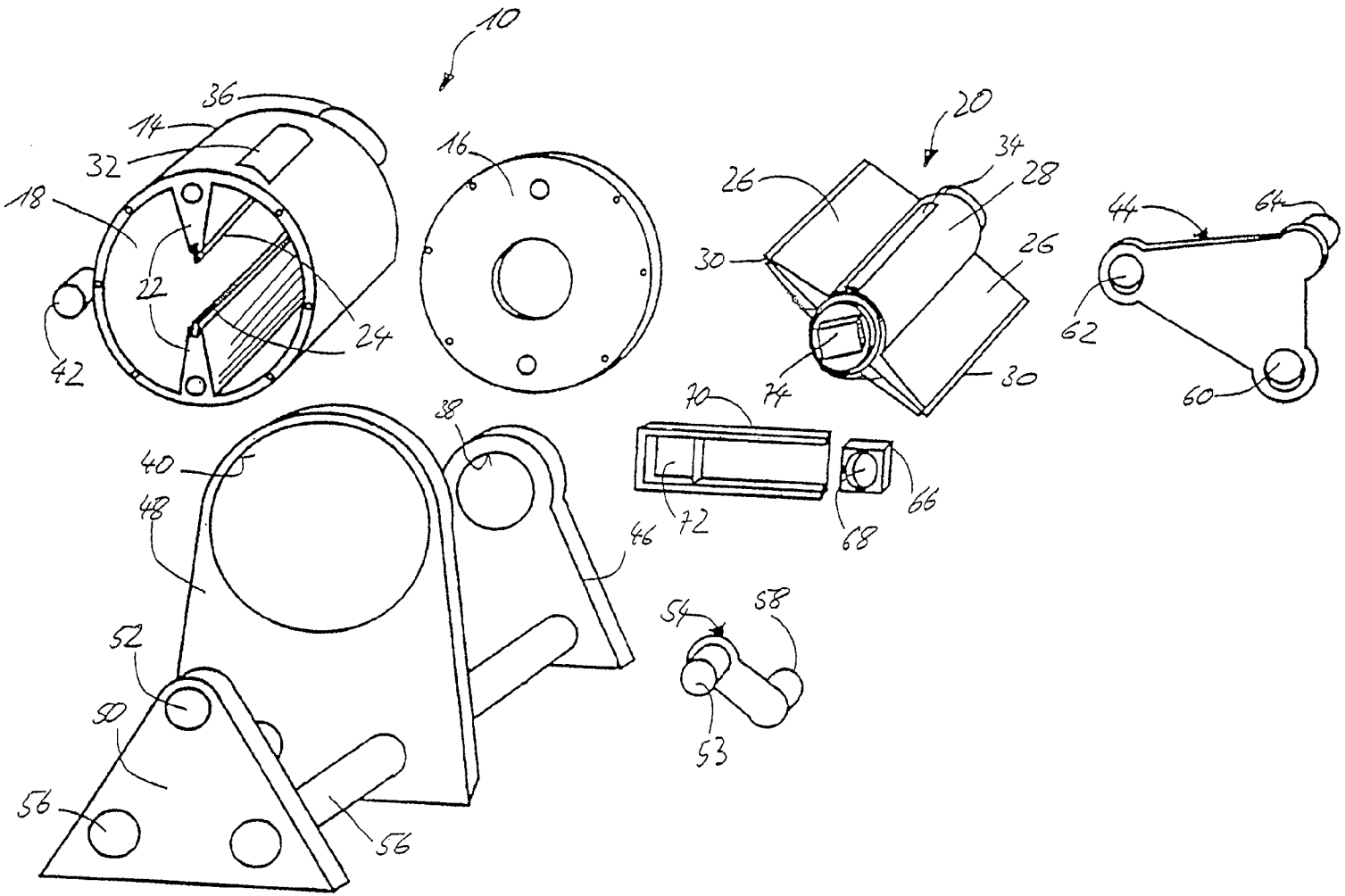
FIG. 2*b* illustrates the rotary piston engine of FIG. 2*a* in an exploded view.

The representations of FIGS. 2*a* and 2*b* show a rotary piston engine in accordance with the invention and in accordance with a first embodiment of the invention. With regard to the schematic representation in FIG. 2*a*, it must be borne in mind that there the individual elements are drawn inside one another as a wire frame model, so that lines which are not discernable to the beholder are also shown. It can be seen that the rotary piston engine has a cylinder liner 10 that is received rotatably in a frame 12. The cylinder liner 10 comprises a cup-like section 14 and a cover plate 16 which in the assembled state closes off a working space 18 inside the cylinder liner 10. Inside the cylinder liner 10 and concentric thereto, a rotor 20 is held that is mounted rotatably relative to the cylinder liner 10. The cylinder liner 10 has two approximately wedge-shaped ribs 22 opposite to one another that extend from an all-round wall of the cylinder liner 10 in the direction of its central longitudinal axis. At their respective ends facing the central longitudinal axis, the ribs 22 are provided with sealing strips 24.

The rotor 20 also has two opposite ribs 26 extending radially outwards from a cylindrical central portion 28 of the rotor 20 and whose wedge-shaped cross-sections taper as the radius increases. The outer edges of the ribs 26 are provided with sealing strips 30.

After arrangement of the rotor 20 inside the cup-like section 14 of the cylinder liner 10, the sealing strips 24 of the ribs 22 of the cylinder liner 10 are in sealing contact with the cylindrical central portion 28 of the rotor 20. The sealing strips 30 at the radially outer ends of the ribs 26 of the rotor are in turn in sealing contact with the inner wall of the cylinder liner 10. After insertion of the rotor 20 into the cylinder liner 10, a working space 18 inside the cylinder liner 10 is thus split into four sections. During rotary movement of the rotor 20 relative to the cylinder liner 10, these four sections change in size. With a relative movement periodically oscillating between a positive and a negative rotational speed between the rotor and the cylinder liner 10, a gas present in the various sections of the working space 18 is thus alternately condensed and compressed.

The cylinder liner 10 is provided in its outer wall with two outlet openings 32, only one of which is discernible in the representations in FIGS. 2*a*, 2*b*. The cylindrical central portion 28 of the rotor 20 is designed hollow and gases from the working space 18 inside the cylinder liner 10 can get into the interior of the cylindrical central portion 28 of the rotor 20 and in the final analysis into the environment. Conversely, the inlet opening 34 can of course also be designed as the outlet opening and the outlet opening 32 as the inlet opening.

Since the cylinder liner 10 rotates continuously during operation of the rotary piston engine, the cylinder liner 10 is still enclosed by a ring chamber, not shown in FIG. 2, that is stationary relative to the frame 12 and which for example provides an intake chamber.

The cylinder liner 10 is held in the frame 12 at its one end with a cylinder shaft 36 which is mounted in a suitable bore 38 of the frame 12. At its other end the cylinder liner 10 is mounted rotatably with its outer circumference in a suitable bore 40 of the frame 12. This bore 40 in the frame 12 is so large that the cylinder liner 10 with its smaller-diameter cylinder shaft 36 can be pushed through this bore until the cylinder shaft 36 is arranged inside the bore 38 in the frame. That end of the cylinder liner 10 opposite the cylinder shaft 36 and closed off during operation by the cover plate 16 is thus accessible from the front of the frame 12 facing the beholder in FIG. 2. At this front end of the cylinder liner 10, a gudgeon 42 is arranged which is engaged by a connecting rod 44 of a gear mechanism, as set forth in the following.

The frame 12 has in the embodiment shown in FIG. 2 a total of three plates 46, 48, 50 arranged parallel to one another. The rearmost of these plates 46 in FIG. 2 contains the bore 38 for receiving the cylinder shaft 36, the middle one of the plates 48 the bore 40 for receiving the outer circumference of the cylinder liner 10, and the front one of these plates 50 a bearing bore 52 for receiving a gudgeon 53 of a rotational element 54 designed as a rotary crank. The three plates 46, 48, 50 of the frame 12 arranged parallel to one another are connected with two rods 56 running parallel to one another.

A gear mechanism using which the synchronization of the rotor 20 and the cylinder liner 10 is effected so that these perform during a rotary movement of the cylinder liner 10 or of the rotor 20 a relative movement periodically oscillating about a zero crossing, is arranged between the front plate 50 in FIG. 2 and the end of the cylinder liner 10 on which the gudgeon 42 is arranged. The gear mechanism thus engages the outer circumference of the cylinder liner 10, the rotor 20 and the frame 12 and is therefore arranged outside the working space 18 which is inside the cylinder liner 10. This allows the working space 18 itself to be designed unaffected by space requirements for accommodation of the gear mechanism. The engagement of the gear mechanism on the outer circumference of the cylinder liner 10 also permits the transmission of very high torques with low stresses on joints. The arrangement of the gear mechanism between the front plate 50 and the cylinder liner 10 affords ample latitude in the design of the gear mechanism, since no frame struts or housing walls limit the movements of the individual gear members. In the rotary piston engine in accordance with the invention, relative rotational angles of 160° between the rotor 20 and the cylinder liner 10 can be achieved as a result.

A first rotational joint of the gear mechanism is formed by the gudgeon 53 of the rotational element 54 and the bearing bore 52 in the frame 12. The gear mechanism has in addition to the rotational element 54 the connecting rod 44 which is rotatably connected to the rotational element 54 by a second rotational joint, the latter being formed by a gudgeon 58 on the rotational element 54 and by a bearing bore 60 on the connecting rod 44. The rotational element 54 is furthermore rotatably connected to the cylinder liner 10 by a third rotational joint, the third rotational joint being formed by a bearing bore 62 on the connecting rod 44 and by the gudgeon 42 on the cylinder liner 10. The connecting rod 44 is also connected to the rotor 20 by a rotational/prismatic joint formed by a gudgeon 64 on the connecting rod 44, a sliding block 66 having a bearing bore 68 for receiving the gudgeon 64 and a sliding block guide 70 which is rigidly connected to the central portion 28 of the rotor 20 by fitting a rectangular passage opening 72 on the sliding block guide 70 onto a matching rectangular projection 74 on the rotor 20. The sliding block 66 can thus move in linear manner inside the sliding block guide 70 and the connecting rod 44 is in turn mounted rotatably in the bearing bore 68 of the sliding block 66 by means of its gudgeon 64.

The representations in FIGS. 1*a* to 1*d* show various rotational positions of the rotary piston engine in accordance with the invention and in accordance with the first embodiment on the basis of a schematic diagram. In this diagram, the cylinder liner 10 is drawn in as a circle and the gudgeon 42 on the outer circumference of the cylinder liner 10 can be discerned. The frame has not been illustrated for the sake of clarity, but the cylinder liner 10 rotates about a central longitudinal axis O1.

Furthermore, a circular path covered by the gudgeon 58 of the rotational element 54 is identified with 76 and the rotation point of the rotational element 54 on the frame 12 is identified with O2. Also discernible is the sliding block guide 70 which on one side is rigidly fastened to the rotor 20 and thus extends radially outwards from the central longitudinal axis O1 of the cylinder liner 10 and of the rotor 20. Inside the sliding block guide 70, the sliding block 66 is held such that it can move in the radial direction inside the guide 70. The sliding block 66, the gudgeon 42 and the gudgeon 58 of the rotational element 54 are connected to one another by the connecting rod 44.

Figure 1B:
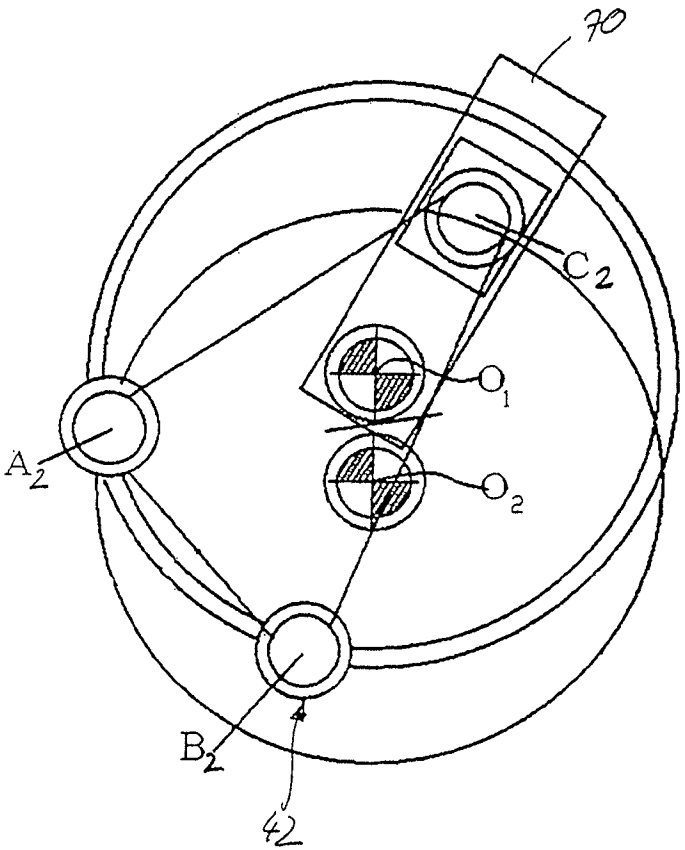
FIGS. 1*a* to 1*d* are kinematic diagrams of a rotary piston engine in accordance with the invention and in accordance with a first embodiment of the invention in various rotational positions.
Figure 1A:
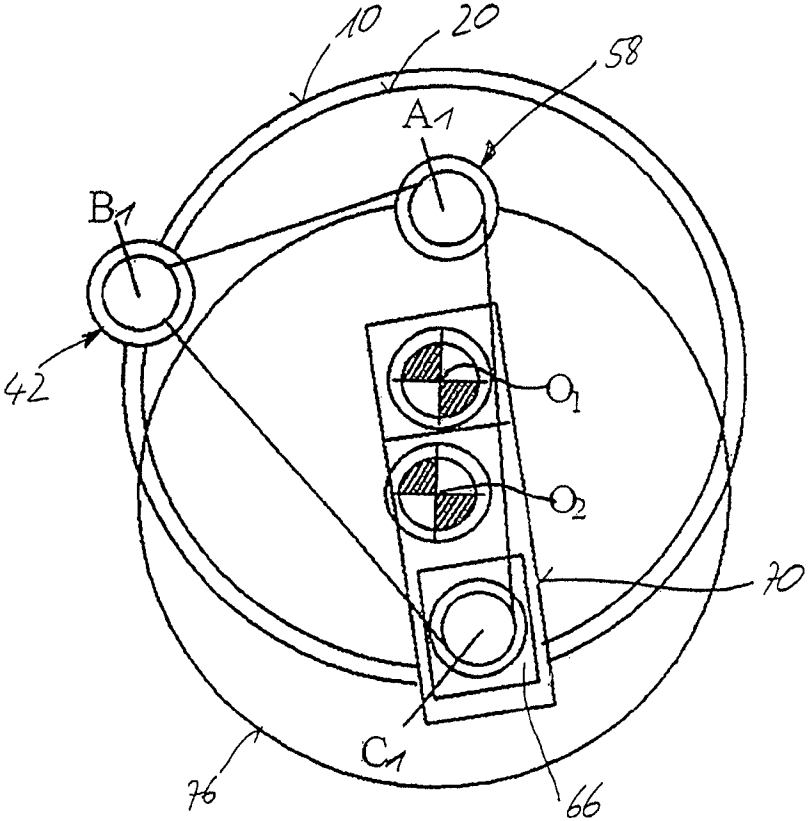

The representation in FIG. 1*a* shows a first rotational position of the rotary piston engine, and based on a comparison with the representation in FIG. 1*b* of a second rotational position of the rotary piston engine it can be seen that in the counterclockwise rotation as shown the cylinder liner 10 continues to rotate somewhat further than a quarter-turn, discernible from the position B1 of the gudgeon 42 in FIG. 1*a* top left and position B2 of this gudgeon 42 in FIG. 1*b* bottom left. The rotor 20 however rotates about a larger angle, as can be seen from the position C1 of the sliding block guide 70 in FIG. 1*a* and in comparison to this position C2 in FIG. 1*b*. The rotor 20 thus leads the cylinder liner 10 between FIG. 1*a* and FIG. 1*b*, so that a positive rotational speed is obtained between the rotor 20 and the cylinder liner 10. The rotation of the cylinder liner 10 about the angle B1, O1, B2 is less than the rotation of the rotor 20 about the angle C1, O1, C2. The rotor 20 therefore rotates faster than the cylinder liner 10.

Figure 1D:
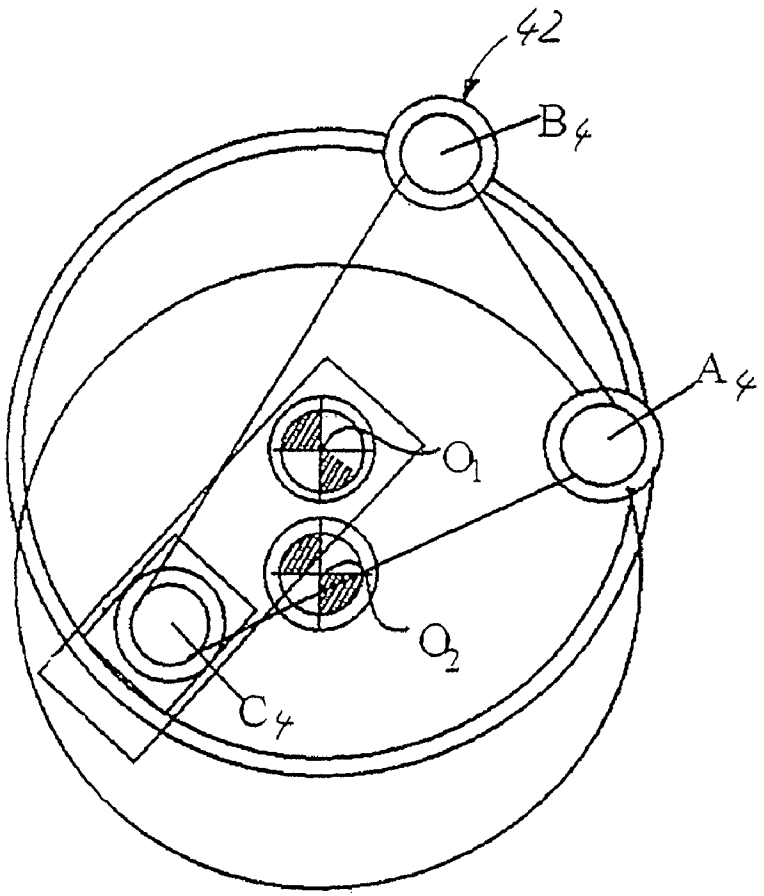
Figure 1C:
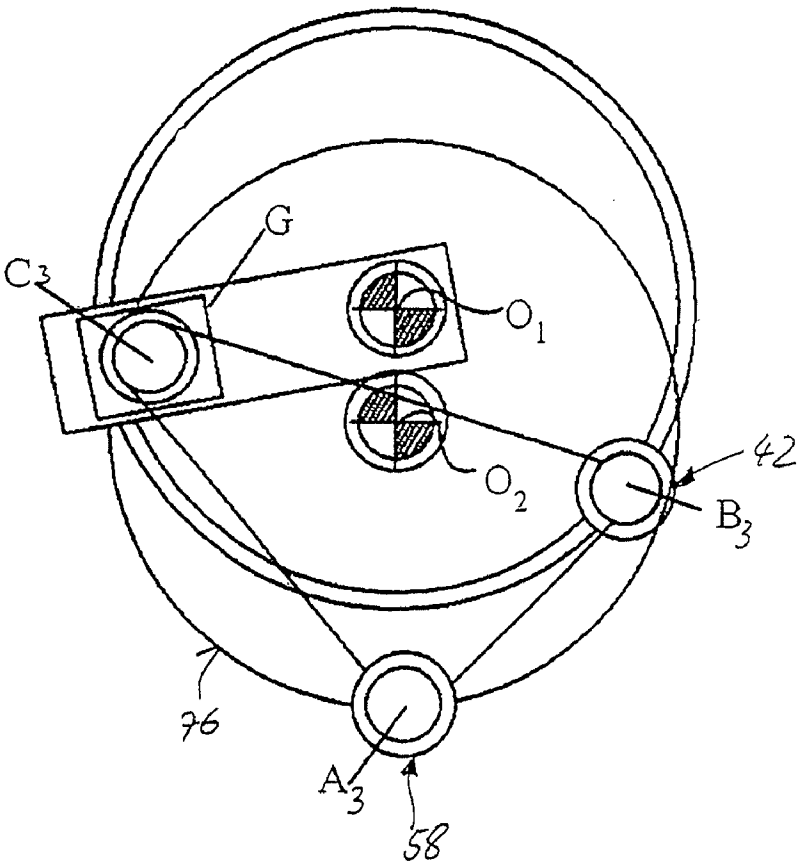

The reverse case occurs when the gudgeon 58 passes the position shown in FIG. 1*c*, i.e. at the bottom of the circular path 76 and then continues to turn. Between the third rotational position in FIG. 1*c* and the fourth rotational position in FIG. 1*d*, the cylinder liner 10 covers approximately a quarter-turn, as can be seen from a comparison of position B3 of the gudgeon 42 in FIG. 1*c* and position B4 of the gudgeon 42 in FIG. 1*d*. The rotor 20 by contrast covers between the third rotational position in FIG. 1*c* and the fourth rotational position in FIG. 1*d* considerably less than one quarter-turn, as can be seen from a comparison of position C3 of the sliding block guide 70 in FIG. 1*c* and its position C4 in FIG. 1*d*. The angle B3, O1, B4 about which the cylinder liner 10 rotates is thus larger than the rotation of the rotor 20 about the angle C3, O1, C4. Between the rotational positions in FIGS. 1*c* and 1*d*, the cylinder liner 10 thus rotates faster than the rotor 20.

A geometric analysis shows that the overtaking process of the rotor in the first half-turn, i.e. between the first rotational position in FIG. 1*a* and the second rotational position in FIG. 1*b*, is exactly the same as the overtaking process of the cylinder liner 10 in the second half-turn, i.e. between the third rotational position in FIG. 1*c* and the fourth rotational position in FIG. 1*d*. After a full revolution of the cylinder liner 10 and of the rotor 20, the relative rotation between the cylinder liner 10 and the rotor 20 is thus zero. In the case of a continuous rotation of the cylinder liner 10 and of the rotor 20, this leads to a relative movement oscillating about a zero crossing of rotor 20 and cylinder liner 10, hence a relative movement that oscillates between positive and negative rotational speed. In other words, the rotor 20 periodically leads or lags the cylinder liner 10, with the relative movement extending over a rotational angle of approx. 160°.

On the basis of the representations in FIGS. 1*a*, 1*b*, 1*c*, 1*d* and 2*a*, 2*b*, it can be seen that the rotary piston engine in accordance with the first embodiment represents a special gear with a total of six members and seven joints. The members are here the cylinder liner 10, the rotor 20, the rotational element 54, the connecting rod 44, the sliding block 66 and the frame 12. The seven joints are formed by the rotary mounting of the cylinder liner 10 in the frame 12, the rotary mounting of the rotor 20 in the cylinder liner 10, the mounting of the rotational element 54 on the frame 12, the mounting of the rotational element 54 on the connecting rod 44, the mounting of the connecting rod 44 on the cylinder liner 10, the mounting of the connecting rod 44 on the sliding block 66 and the mounting of the sliding block 66 in the sliding block guide 70. All articulation points move in planes parallel to one another, so that this is by definition a flat gear. All joints have the degree of freedom f=1. The degree of freedom F of the gear is thus 1. The degree of freedom F results in accordance with the formula $$F=3*(n-1)-2*g1+g2=3*-2*7=1$$

where n is the number of members, g1 the number of joints with the degree of freedom F=1 and g2 the number of joints with the degree of freedom f=2, in the present case g2=0.

For rotatability, this gear should meet a similar condition to the Grashof Condition for four-joint gears, which does not however present any major difficulties.

Figure 4A:
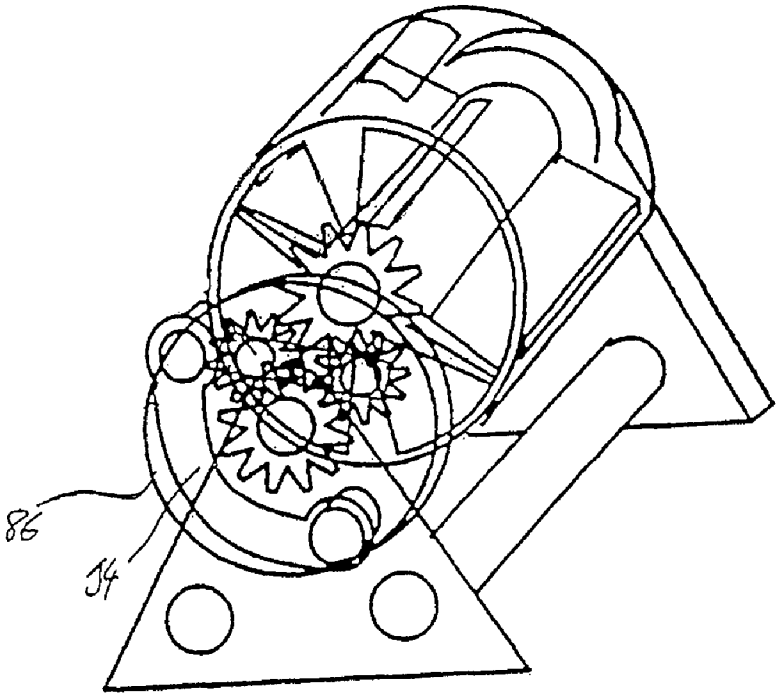
FIG. 4*a* illustrates the rotary piston engine in accordance with the second embodiment of the invention as a 3-D wire frame model.
Figure 4B:
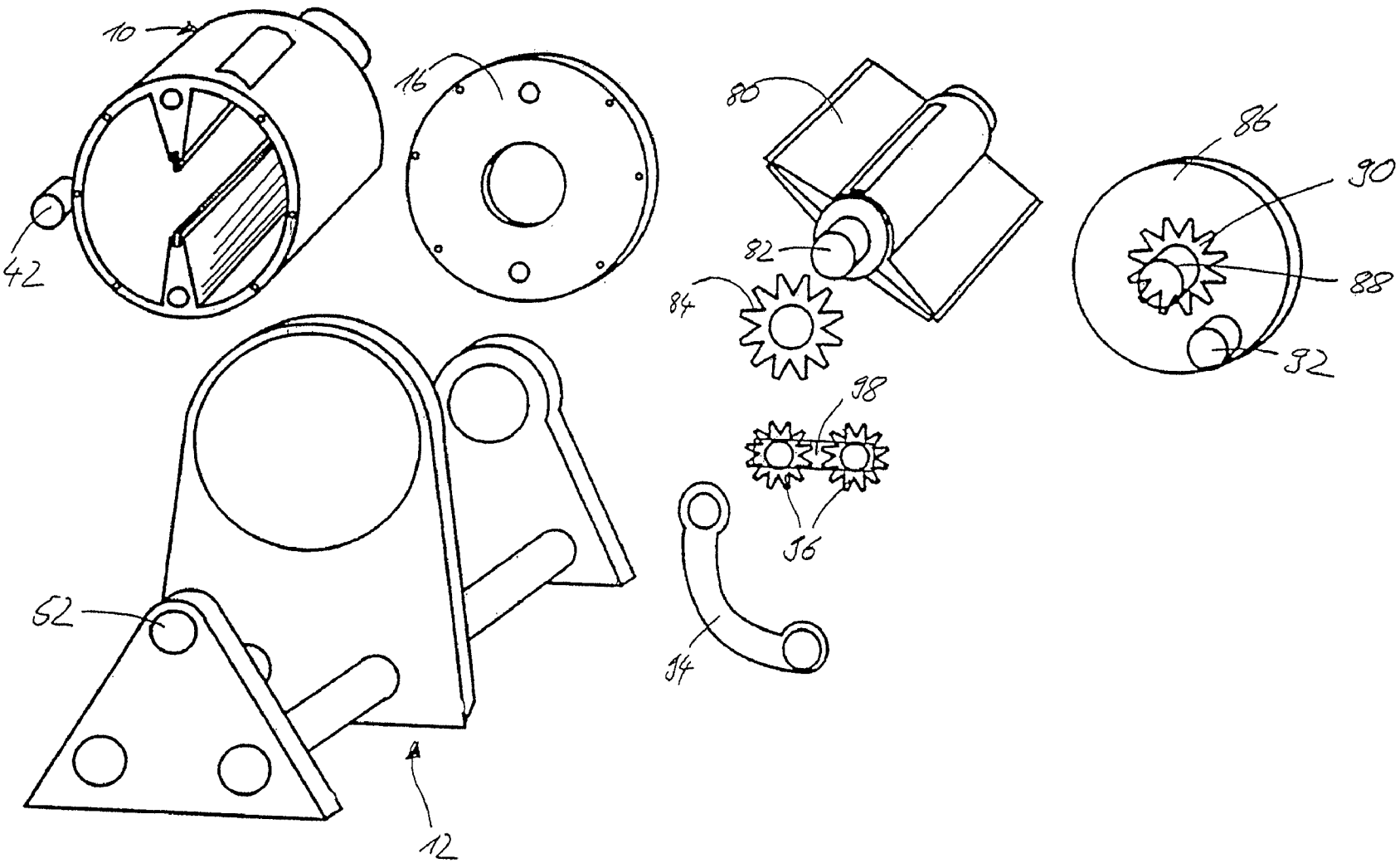
FIG. 4*b* illustrates the rotary piston engine of FIG. 4*a* in an exploded view.

The representation in FIG. 4*a* shows a schematic wire frame model of a rotary piston engine in accordance with a second preferred embodiment of the invention in a perspective view, and the representation in FIG. 4*b* shows the rotary piston engine of FIG. 4*a* in an exploded view. As regards the representation of FIG. 4*a*, it must be noted that like the representation of FIG. 2*a* lines not discernible per se are also shown. The rotary piston engine in FIG. 4*a* has, like the already explained rotary piston engine from FIG. 2*a*, a cylinder liner 10 with a cover plate 16 held rotatably inside a frame 12. The cylinder liner 10 and the frame 12 are designed identical to the cylinder liner 10 and the frame 12 of the rotary piston engine in FIG. 2*a* and are therefore not described again.

The cylinder liner 10 accommodates a rotor 80 that differs only slightly from the rotor 20 of the rotary piston engine in FIG. 2, so only these differences are explained. The rotor 80 has at its front end in FIG. 4*a* a stub shaft 82 on which a first gearwheel 84 can be non-rotatably fastened. In the assembled state of the rotary piston engine, the stub shaft 82 extends through the cover plate 16 and is sealed off from the latter, and the gearwheel 84 is then non-rotatably fastened on the stub shaft 82.

The rotary piston engine in FIGS. 4*a*, 4*b* furthermore has a rotary disc 86 which has a gudgeon 88 extending from its centre and is provided concentrically to its centre with a second gearwheel 90. The second gearwheel 90 is arranged non-rotatably on the gudgeon 88, which extends from the centre of the rotary disc 86 towards the same side as a further gudgeon 92. The centrally arranged gudgeon 88 on the rotary disc 86 is mounted in the bearing bore 52 of the frame 12, so that the rotary disc 86 can perform a rotation movement about its centre point relative to the frame 12.

The further gudgeon 92 is used for articulated arrangement of a connecting rod 94 which is connected on the one hand rotatably to the gudgeon 92 and on the other hand rotatably to the gudgeon 42 on the outer circumference of the cylinder liner 10. The first gearwheel 84 and the second gearwheel 90 are of equal size and have the same number of teeth, and are connected to one another by means of two intermediate gearwheels 96 that are arranged freely rotatable on a bearing beam 98 or in a bearing cage. The two intermediate gearwheels 96 ensure a connection of the first and the second gearwheels 84, 90 and hence a synchronization of the rotary movement of the rotary disc 86 and the rotor 80. The connecting rod 94 is then used to synchronize the rotary movement of the cylinder liner 10 with the rotary movement of the rotary disc 86, and rotor 80 and cylinder liner 10 are coupled to one another such that a relative movement between the cylinder liner and the rotor 80 oscillates periodically between positive and negative rotational speed.

A gear mechanism coupling the frame 12, the rotor 80 and the cylinder liner 10 to one another thus comprises the connecting rod 94 that connects the gudgeon 42 of the cylinder liner 10 to the gudgeon 92 of the rotary disc 86. The rotary disc 86 is in turn mounted rotatably about its centre point on the frame 12. The rotary disc 86 is provided with the second gearwheel 90 concentrically to its centre point, and with this second gearwheel 90 and the two intermediate gearwheels 96 the rotary disc 86 is coupled to the rotor 80 having the first gearwheel 84 concentric to its centre longitudinal axis. Instead of the two intermediate gearwheels 96, it is shown that only one intermediate gearwheel can be used, with a modified design then having to be selected in this case.

Figure 3B:
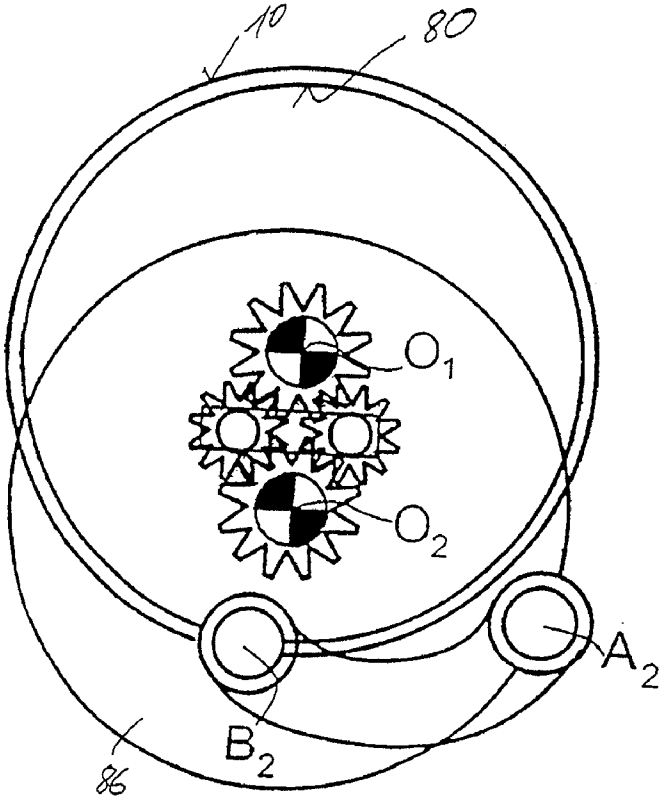
FIGS. 3*a* to 3*d* are kinematic diagrams of a rotary piston engine in accordance with the invention and in accordance with a second embodiment in various rotational positions.
Figure 3A:
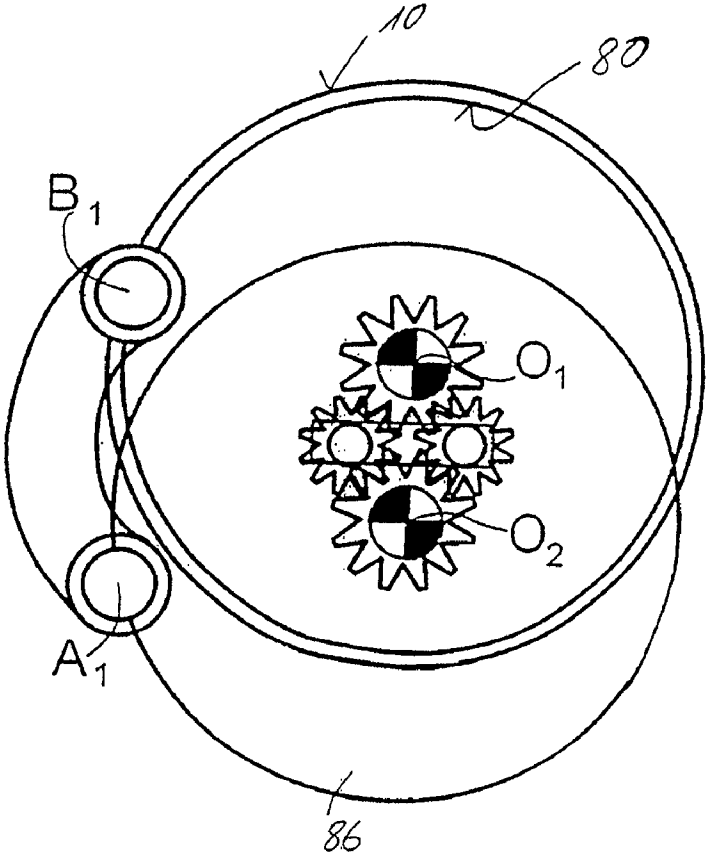

The representations of FIGS. 3*a* to 3*d* show various rotational positions of the rotary piston engine of FIG. 4*a*. It can be seen that during a rotation of the cylinder liner 10 in the first half-turn, corresponding to the transition from the rotational position in FIG. 3*a* to the rotational position of FIG. 3*b*, the rotary disc 86 and the rotor 80 connected thereto by the gearwheels rotate faster than the cylinder liner 10. Accordingly, the angle A1, O2, A2 covered by the rotary disc 86 between the rotational positions of FIGS. 3*a* and 3*b* is larger than the angle B1, O1, B2 that the cylinder liner 10 covers between these two rotational positions.

Figure 3D:
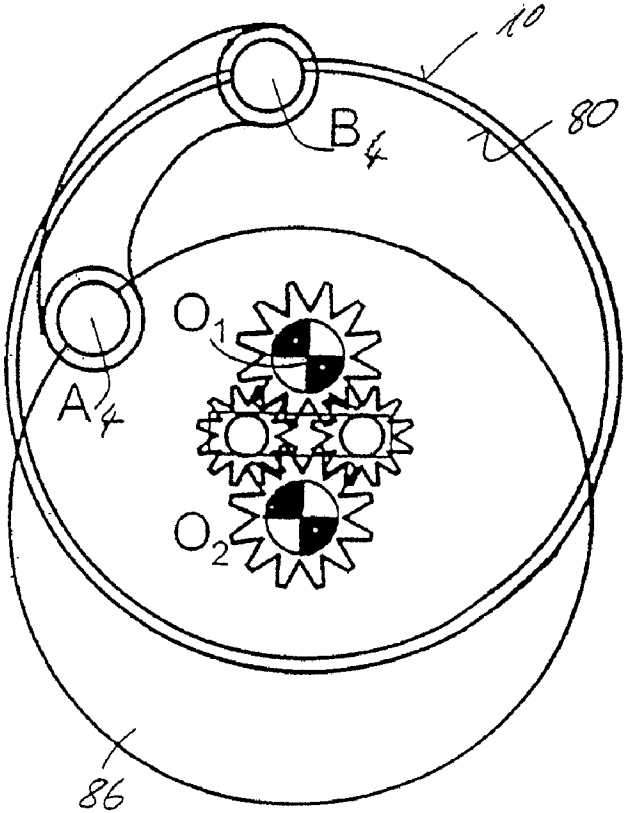
Figure 3C:
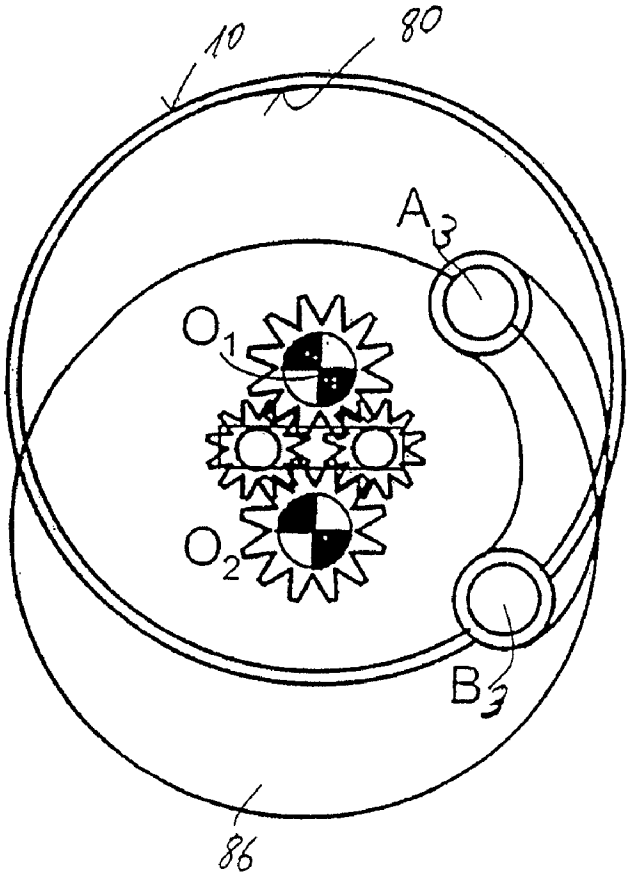

In the second half-turn, corresponding to the transition from the rotational position shown in FIG. 3*c* to the rotational position shown in FIG. 3*d*, the rotor 80 then rotates more slowly than the cylinder liner 10, since the angle A3, O2, A4 is smaller than the angle B3, O1, B4. As a result, the cylinder liner 10 and the rotor 80 move relative to one another, more precisely in a relative movement between the cylinder liner 10 and the rotor 80 periodically oscillating about a zero crossing between positive and negative rotational speed.

It is of course possible to arrange a first gear as shown in FIG. 4*a* and to arrange a second rotation mechanism on the opposite side of the cylinder liner 10 in order to reduce joint stresses and to transmit a higher torque. Furthermore, it is shown that the rotor 80 and the cylinder liner 10 could be designed with not only two ribs opposite to one another, but also for example with four ribs projecting into the working space in order to form a multi-section working space.

Figure 6A:
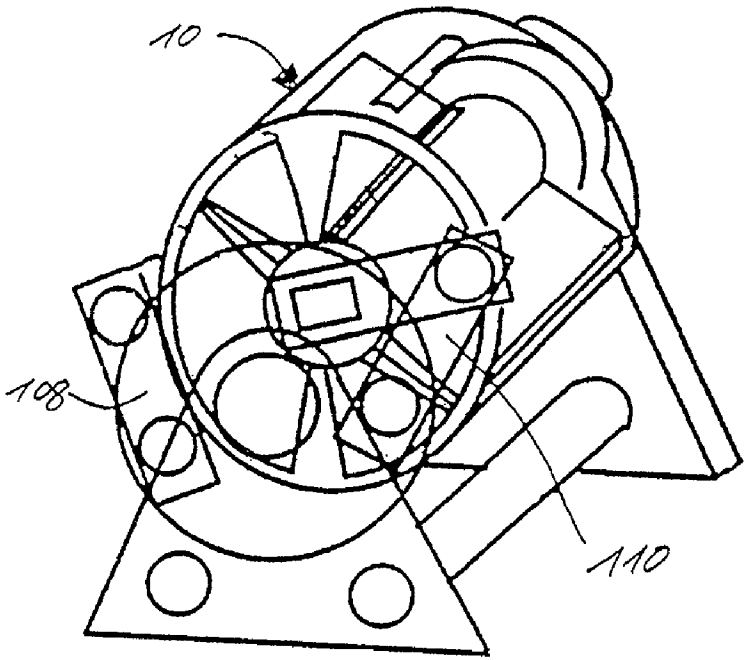
FIG. 6*a* illustrates the rotary piston engine in accordance with the third embodiment of the invention as a 3-D wire frame model.
Figure 6B:
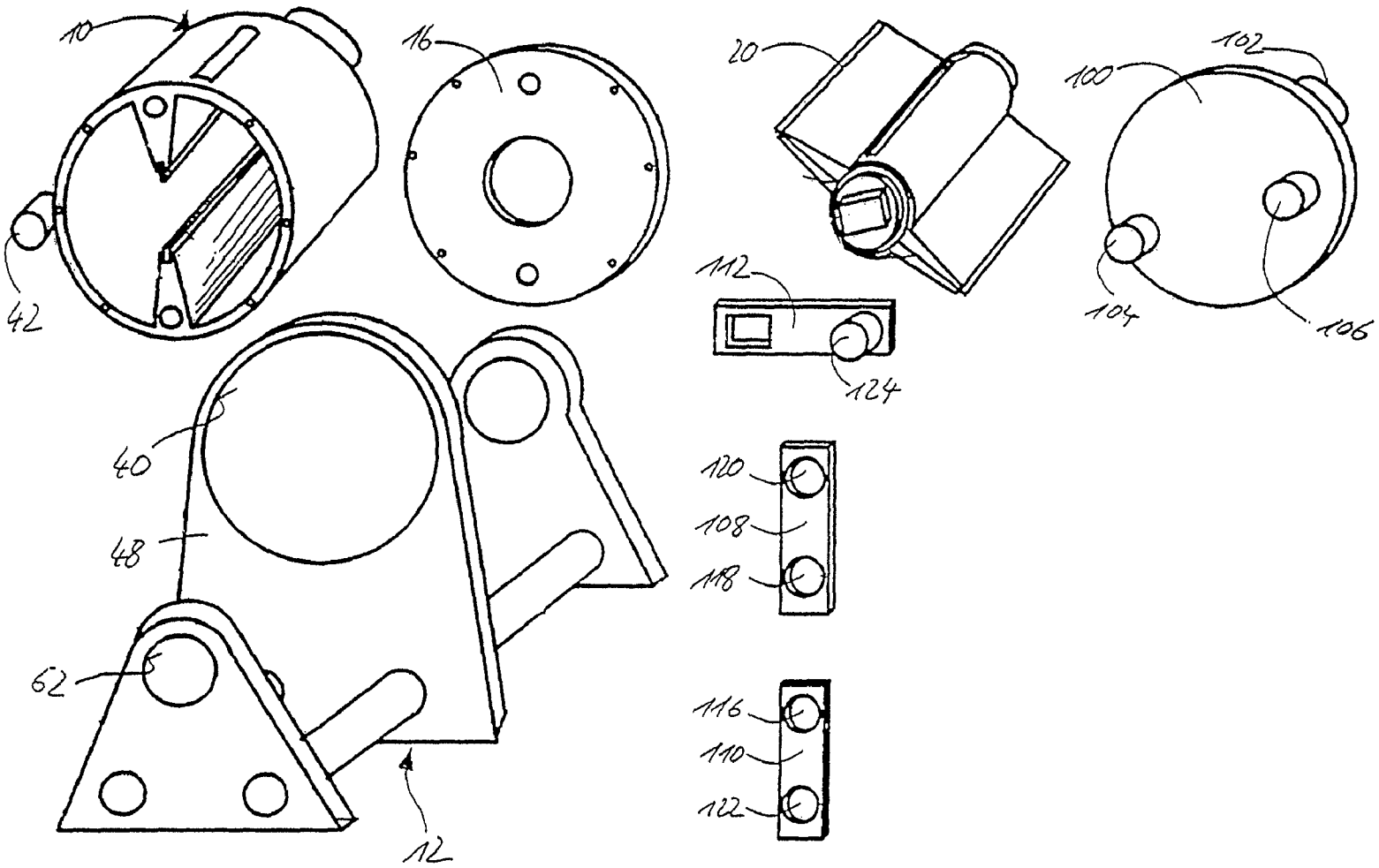
FIG. 6*b* illustrates the rotary piston engine of FIG. 6*a* in an exploded view.

The representation in FIG. 6*a* shows a third preferred embodiment of a rotary piston engine in accordance with the invention as a wire frame model in a perspective view. In FIG. 6*a* too, as in FIGS. 2*a* and 4*a*, lines are drawn in that would not be discernible to the beholder. The representation in FIG. 6*b* shows the rotary piston engine from FIG. 6*a* in an exploded view. For simplicity's sake, only those parts of the rotary piston engine are described that differ from the various components of the rotary piston engine from FIG. 2*a*. For example the cylinder liner 10, the cover plate 16, the rotor 20 and the frame 12 are designed identical to those in the rotary piston engine from FIG. 2*a*. The gear mechanism coupling the cylinder liner 10, the rotor 20 and the frame 12 is of different design. This gear mechanism has a rotary disc 100 rotatably arranged in the bearing bore 52 of the frame 12 by means of a bearing gudgeon 102 arranged concentrically to its centre point. The rotary disc 100 has two gudgeon 104 and 106 arranged at a distance from the centre point of the rotary disc 100. One connecting rod 108, 110 each is rotatably connected to these two gudgeons 104, 106. The first connecting rod 108 is rotatably connected at its end opposite the gudgeon 104 to the gudgeon 42 of the cylinder liner 10. The second connecting rod 110 is rotatably connected at its end opposite the gudgeon 106 to the rotor 20, the connection being made by a crank 112 which on the one hand is non-rotatably fastened on the central longitudinal axis of the rotor 20 and on the other hand has radially and at a distance from this central longitudinal axis a gudgeon 114 which forms, together with a bearing bore 116 in the second connecting rod 110, a rotational joint.

The rotary piston engine shown in FIGS. 6*a* and 6*b* thus forms overall a gear with seven rotational joints with a degree of freedom of 1. The gear mechanism itself has a first rotational joint that connects the rotary disc 100 to the frame 12 and that is formed by the concentric shaft gudgeon 102 on the rotary disc 100 and the bearing bore 52 on the frame 12. A second rotational joint is formed by the gudgeon 104 on the rotary disc 100 and by a first bearing bore 118 on the first connecting rod 108. A third rotational joint is formed by the second bearing bore 120 in the first connecting rod 108 and by the gudgeon 42 on the cylinder liner 10. A fourth rotational joint is formed by the gudgeon 106 on the rotary disc 100 and by the first bearing bore 122 on the second connecting rod 110. A fifth rotational joint is formed by the second bearing bore 116 on the second connecting rod 110 and by the gudgeon 124 on the crank 112 of the rotor 20. A sixth rotational joint is formed by the rotatable mounting of the rotor 20 in the cylinder liner 10 and a seventh rotational joint is formed by the rotatable mounting of the cylinder liner 10 in the frame 12.

As in the rotary piston engines in accordance with FIGS. 2*a*, 2*b*, and 4*a*, 4*b*, the gear mechanism engages the cylinder liner 10 radially outside the working space. The gear mechanism is arranged directly in front of the cylinder liner 10 and the rotor 20, without insertion of a frame strut or the like, so that the gear mechanism can directly engage the cylinder liner 10 or the rotor 20, achieving a very compact and simple design. Furthermore, the cylinder liner 10 is likewise mounted in the frame 12 by its outer circumference, i.e. in the bore 40 of the central plate 48 of the frame. It can be seen that a further and identical gear mechanism could be arranged directly behind the cylinder liner in order to reduce the torque to be transmitted by every gear mechanism and to construct, for example, a very compact pump.

The representations of FIGS. 5*a* to 5*d* show different rotational positions of the rotary piston engine in FIG. 6*a*, with the representation of a kinematic diagram being chosen. The cylinder liner 10 is represented by a circle, the rotor 20 by a smaller circle concentric to the cylinder liner. Cylinder liner 10 and rotor 20 rotate about the central longitudinal axis O1. The rotary disc 100 is represented by two circles concentric to one another, where a first larger circle 130 represents the orbit of the centre point of the gudgeon 104 and a second smaller circle 132 concentric to the first circle represents the orbit of the centre point of gudgeon 106. The rotary disc 100 rotates about an axis O2 running through the centre point of the bearing bore 52 in frame 12, cf. FIG. 6*b*. The first connecting rod 108 is shown as a simple line and connects the gudgeon 104 on the rotary disc 100 to the gudgeon 42 on the cylinder liner 10. The second connecting rod 110 is also shown as a simple line and connects the gudgeon 106 on the rotary disc 100 to the gudgeon 124 on the crank 112 which is rigidly connected to the rotor 20.

Figure 5B:
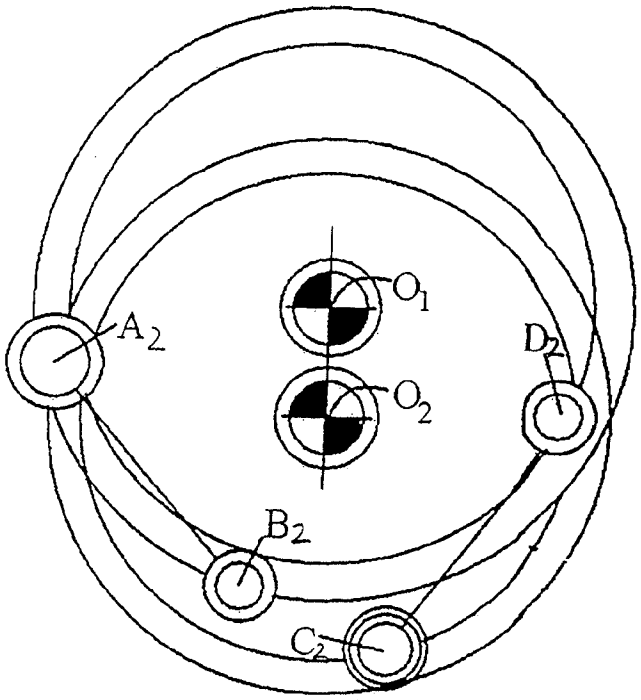
FIGS. 5*a* to 5*d* are kinematic diagrams of a rotary piston engine in accordance with the invention and in accordance with a third embodiment in various rotational positions.
Figure 5A:
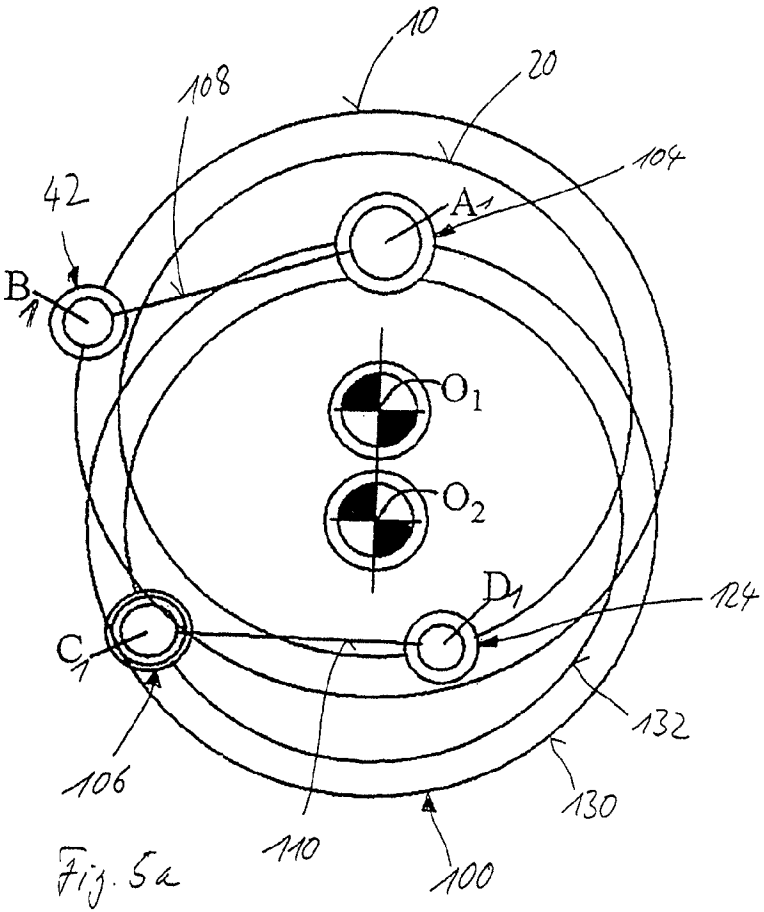
Figure 5D:
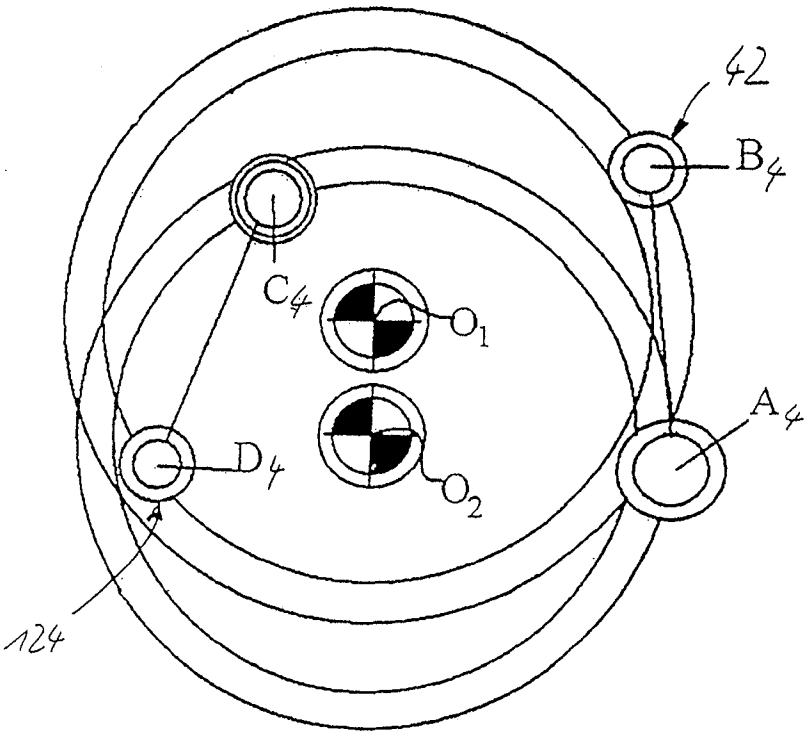
Figure 5C:
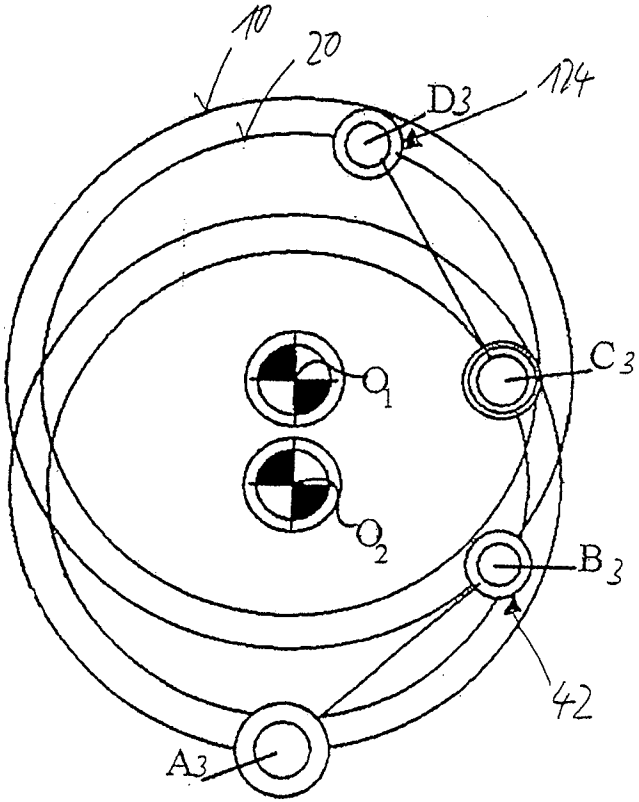

On the basis of the transition of the rotational position of cylinder liner 10 and rotor 20 from the first position shown in FIG. 5*a* to the second position shown in FIG. 5*b*, it can be seen that a relative rotation between the cylinder liner 10 and the rotor takes place, with the cylinder liner 10 rotating faster between the two rotational positions in FIGS. 5*a* and 5*b* than the rotor 20. The cylinder liner 10 or its gudgeon 42 rotates from a position B1 in FIG. 5*a* to a position B2 in FIG. 5*b*. The rotor 20 or the gudgeon 124 rotates from a position D1 in FIG. 5*a* to a position D2 in FIG. 5*b*. The angle B1, O1, B2 is here larger than the angle D1, O1, D2, so that the cylinder liner 10 rotates faster than the rotor 20. In the second half-turn, shown by the transition between the rotational positions of FIGS. 5*c* and 5*d*, the rotor 20 then rotates faster than the cylinder liner 10. The cylinder liner 10 or its gudgeon 42 rotates from a position B3 in FIG. 5*c* to a position B4 in FIG. 5*d*. The rotor 20 or the gudgeon 124 on the crank 112 by contrast rotates from a position D3 in FIG. 5*c* to a position D4 in FIG. 5*d*. The angle B3, O1, B4 is smaller than the angle D3, O1, D4, so that the cylinder liner 10 rotates more slowly than the rotor 20.

A geometric view shows that the lead of the cylinder liner 10 in the first half-turn is exactly the same as the lead of the rotor 20 in the second half-turn. This means that with a full revolution of the cylinder liner 10, the rotor 20 and the rotary disc 100, the relative rotation of the cylinder liner 10 and of the rotor 20 is thus zero. The result of this is the relative movement of the cylinder liner 10 and of the rotor 20 that oscillates between positive and negative rotational speed, corresponding to an alternating compression and expansion of the sectors of the working space between the ribs of the cylinder liner 10 and of the rotor 20.

The rotary piston engine shown in FIGS. 5*a* to 5*d* and 6*a*, 6*b* too, and in particular its gear mechanism, meets the aforementioned formula for flat gears.

In summary, the invention provides three embodiments of relatively easily constructed and easily implemented gear mechanisms for matching of the rotation movement of a cylinder liner and a rotor mounted concentrically therein and meeting the function of a piston. A first rotation mechanism in accordance with FIGS. 1*a* to 1*d* and 2*a*, 2*b* forms together with the cylinder liner 10 and the rotor 20 a six-member special gear with five rotational joints and one rotational/prismatic joint with a degree of freedom of 1. The second gear mechanism in accordance with FIGS. 3*a* to 3*d* and FIGS. 4*a*, 4*b*, forms together with the cylinder liner 10 and the rotor 80 a six-member special gear with two gearwheel transmissions and five rotational joints with a degree of freedom of 1. The third gear mechanism proposed in accordance with FIGS. 5*a* to 5*d* and FIGS. 6*a*, 6*b* forms together with the cylinder liner 10 and the rotor 20 a six-member gear with seven rotational joints with a degree of freedom of 1. The purely rotational relative movement between cylinder liner 10 and rotor 20, 80 exclusively about their common rotation axis allows a very high degree of sealing to be achieved, since the respective sealing strips 24, 30, cf. FIG. 2*b*, are not subjected to a lateral force. The simplicity of the proposed designs and the large number of crucial geometric parameters available for optimization allow the working processes in the working space between the cylinder liner 10 and the rotor 20, 80 to be optimized and the stresses in the joints to be reduced. The resultant designs of the respective gear mechanisms are very compact. In the design of a combustion engine, the rotary piston engine in accordance with the invention can be even more compact than that of a Wankel engine. No valves are needed for the load change, and for charge injection there is no longer any need for camshafts. The rotating cylinder liner 10 permits additional air cooling to be dispensed with.

The invention claimed is:

1. A rotary piston engine comprising:

a frame, a cylinder liner mounted on a cylinder shaft rotatably in the frame, wedge-shaped ribs extending from an inner wall of the cylinder liner and being opposite to one another, a rotor mounted on a cylindrical central portion coaxially in the cylinder liner, and a gear mechanism connecting the frame, the cylinder liner and the rotor, wherein the gear mechanism is positioned outside a working space arranged between the cylinder liner with the rotor and the wedge-shaped ribs, and the gear mechanism couples on an outer circumference of the cylinder liner and the rotor so that the rotor periodically leads and lags relative to the cylinder liner, wherein the gear mechanism and the outer circumference of the cylinder liner form with the rotor a transmission with five rotational joints with a degree of freedom of 1 and one rotational/prismatic joint, wherein the gear mechanism has a rotational element mounted rotatably on the frame by a first rotational joint, and wherein a connecting rod connected by a second rotational joint rotatably to the rotational element and by a third rotational joint rotatably to the cylinder liner and by the rotational/prismatic joint to the rotor.

2. The rotary piston engine according to claim 1, wherein the gear mechanism engages the cylinder liner radially outside the working space.

3. The rotary piston engine according to claim 1, wherein the cylinder liner is mounted inside the frame on the outer circumference of the cylinder liner.

4. A rotary piston engine comprising:

a frame, a cylinder liner mounted on a cylinder shaft rotatably in the frame, wedge-shaped ribs extending from an inner wall of the cylinder liner and being opposite to one another, a rotor mounted on a stub shaft coaxially in the cylinder liner, and a gear mechanism connecting the frame, the cylinder liner and the rotor, wherein the gear mechanism is positioned outside a working space arranged between the cylinder liner with the rotor and the wedge-shaped ribs, and the gear mechanism couples on an outer circumference of the cylinder liner and the rotor so that the rotor periodically leads and lags relative to the cylinder liner, wherein the gear mechanism and the outer circumference of the cylinder liner form with the rotor a transmission with five rotational joints with a degree of freedom of 1 and two gearwheel transmissions, wherein the gear mechanism has a rotary disc mounted rotatably on the frame by a first rotational joint, wherein a connecting rod connected rotatably by a second rotational joint to the rotary disc and rotatably by a third rotational joint to the outer circumference of the cylinder liner, wherein a first gearwheel is non-rotatably connected to the stub shaft, wherein a second gearwheel is non-rotatably connected on a gudgeon extending from a center of the rotary disc, and wherein at least one intermediate gearwheel is meshed with the first gearwheel and the second gearwheel.

5. The rotary piston engine according to claim 4, wherein the gear mechanism engages the cylinder liner radially outside the working space.

6. The rotary piston engine according to claim 4, wherein the cylinder liner is mounted inside the frame on the outer circumference of the cylinder liner.

* * * * *